US006076689A

United States Patent [19]

Vassallo

[11] Patent Number: 6,076,689

[45] **Date of Patent: *Jun. 20, 2000**

[54] CHILD RESISTANT AND ADULT FRIENDLY CONTAINER AND CLOSURE DEVICE

[75] Inventor: John A. Vassallo, Lititz, Pa.

[73] Assignee: Kerr Group, Inc., Lancaster, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 09/019,536

[22] Filed: Feb. 5, 1998

[51] Int. Cl.[7] ..... B65D 41/04; B65D 50/08; B65D 55/02

[52] U.S. Cl. ..... 215/209; 215/44; 215/218; 215/221; 215/330

[58] Field of Search ..... 215/44, 43, 201, 215/209, 217, 218, 221, 329, 330; 220/326

[56] References Cited

U.S. PATENT DOCUMENTS

| | | | |
|---|---|---|---|
| 3,884,379 | 5/1975 | Landen | 215/221 |
| 3,892,326 | 7/1975 | Schneible | 215/221 |
| 3,902,620 | 9/1975 | McIntosh . | |
| 4,036,385 | 7/1977 | Morris | 215/209 |
| 4,103,797 | 8/1978 | Morris | 215/209 |
| 4,144,983 | 3/1979 | Pauls et al. . | |
| 4,427,124 | 1/1984 | Marshall et al. . | |
| 4,473,162 | 9/1984 | Donoghue | 215/209 |
| 5,377,858 | 1/1995 | Morris, Sr. | 220/326 |
| 5,413,233 | 5/1995 | Hall . | |
| 5,544,768 | 8/1996 | Gargione | 215/209 |
| 5,562,218 | 10/1996 | Hamilton et al. . | |
| 5,586,671 | 12/1996 | Thomas et al. . | |
| 5,664,693 | 9/1997 | Krall | 215/209 |
| 5,711,442 | 1/1998 | Kusz | 215/209 |

*Primary Examiner*—Allan N. Shoap
*Assistant Examiner*—Niki M. Eloshway
*Attorney, Agent, or Firm*—Kenyon & Kenyon

[57] ABSTRACT

A child resistant adult friendly container and closure device is provided with a pivot arm on the container which engages a detent on the closure. The pivot arm carries on one end a press tab and on an opposite end a locking lug. The locking lug engages with the detent to prevent the closure from being rotated in an opening direction. To open the closure, the press tab is manually depressed, causing the pivot arm to pivot about a point on the container such that the locking lug disengages from the detent on the closure. The closure can thus be unscrewed in a opening direction to obtain the contents of the container.

8 Claims, 9 Drawing Sheets

CHILD RESISTANT AND ADULT FRIENDLY CONTAINER AND CLOSURE DEVICE

FIELD OF THE INVENTION

The present invention relates to a child resistant and adult friendly container and closure device, and more particularly to a container and closure device having a pivot arm mounted on a container where when one end of the pivot arm is manually depressed the other end pivots out and disengages from a detent lock on a closure.

BACKGROUND INFORMATION

It is a recognized problem that children will often reach for and play with containers which contain medicines or other substances which, if improperly taken, can result in serious and harmful health reactions, and in some instances, even death. As a result many forms of child resistant containers have been designed to prevent children from being able to easily open the containers. This, however, has had the undesirable effect that the aged and infirm have also been unable to open the very same containers to reach and take needed medications, or the like.

U.S. Pat. No. 4,144,983 to Pauls et al. relates to a child-resistant closure assembly having a cap which includes a plurality of detents. When the cap is screwed onto the container in a tightening direction, the cap detents engage a cooperating surface of a detent on the container, thereby allowing the cap detents to move past and the cap to be tightly secured to the container. When the cap is screwed off of the container in a loosening direction, a second surface of the detent on the container engages with a detent on the cap to lock the cap in place. To remove the cap a flexible release member carrying the detent on the container is pushed in one direction causing the detent to slide inside of the detents of the cap in the same direction. As the detent slides to the inside this could cause the problem of a jamming of the cap such that it could not be removed either because of expansion of the detents due to temperature increase in the environment or due to breakage of the detent.

U.S. Pat. No. 5,413,233 to Hall relates to a child resistant bottle having a resiliently deformable vertical beam with a locking surface, and a push tab thereon attached at a neck of the bottle. A closure has a ramped tooth projecting inward from an inner surface of the closure, such that when the closure is screwed onto the bottle, the tooth engages the locking surface of the beam in such a manner to prevent any unscrewing of the closure. In order to unscrew the closure from the bottle, the push tab must be manually depressed toward the bottle into a recess thereby removing the locking surface from the tooth on the closure. Again the problem exists that the tooth and the locking surface of the beam may become jammed as dirt or other debris may get caught in the recess in which the vertical beam is to be depressed thus preventing the beam from being depressed enough to disengage the locking surface from the tooth of the closure.

U.S. Pat. No. 5,562,218 to Hamilton et al. relates to a child resistant attachment for containers. A two-piece closure is screwed or snapped onto a container. To open the two-piece closure a spring-like pushtab on one piece containing a vertical extension which engages an interlocking pawl on the second piece is manually depressed. This activation causes the pushtab to disengage from the pawl so that the second piece can be unscrewed from the first piece. Once again, however, the problem exists that the two-piece closure may become jammed if debris lodge in a channel between the pushtab and the first piece to which it is attached, thereby preventing the pushtab from being able to be manually depressed.

SUMMARY OF THE INVENTION

Accordingly, it is an objective of the present invention to provide a container and closure device which is child resistant yet adult friendly in that the device is unopenable by children yet still comparatively easy for the elderly or infirm to open.

It is another objective to provide a container and closure device which will not be subject to jamming, such that the closure is unopenable from the container, either because of breakage or debris.

To achieve the foregoing and further objectives, and in accordances with the purposes of the present invention, as embodied and broadly described herein, the present invention is directed to a child resistant and adult friendly container and closure device. Thus a container, according to an embodiment of the present invention, has a locking lug mounted on a pivot arm which cooperates with a detent mounted on a closure to prevent opening of the container and closure device without first manually depressing a push tab also mounted on the pivot arm. The pivot arm is attached to the container by a pivot at a pivot point. At one end of the pivot arm is the push tab while at the other end is the locking lug. Each end pivots about the pivot point under manual pressure and has a rest position which prevents opening of the closure.

The closure is screwed onto and off of the container by inter-engagement of threads located on a neck of the container and on an inner skirt of the closure. The detent is located on the closure on an outside surface of a lower portion of the skirt and has a cooperating surface and a locking surface. Each surface of the detent cooperates with a corresponding surface on the locking lug of the container when the closure is screwed onto and off of the container in respective closing and opening directions.

When the closure is screwed onto the container in the closing direction, the cooperating surface of the detent of the closure allows the locking lug's cooperating surface to slide over it by pivoting away around the pivot point. The corresponding locking surface of the locking lug abuts the locking surface of the detent and prevents the closure from being rotated off the container in the opening direction. In order to rotate the closure in the opening direction, the push tab on the pivot arm must be manually depressed. By manually depressing the push tab, the locking lug disengages from the detent by again pivoting around the pivot point and thus allowing for the rotation of the closure in the opening direction.

The present invention and its features and advantages will become more apparent from the following detailed description with reference to the accompanying drawings.

DETAILED DESCRIPTION OF THE PREFERRED EMBODIMENTS

Figure 1:
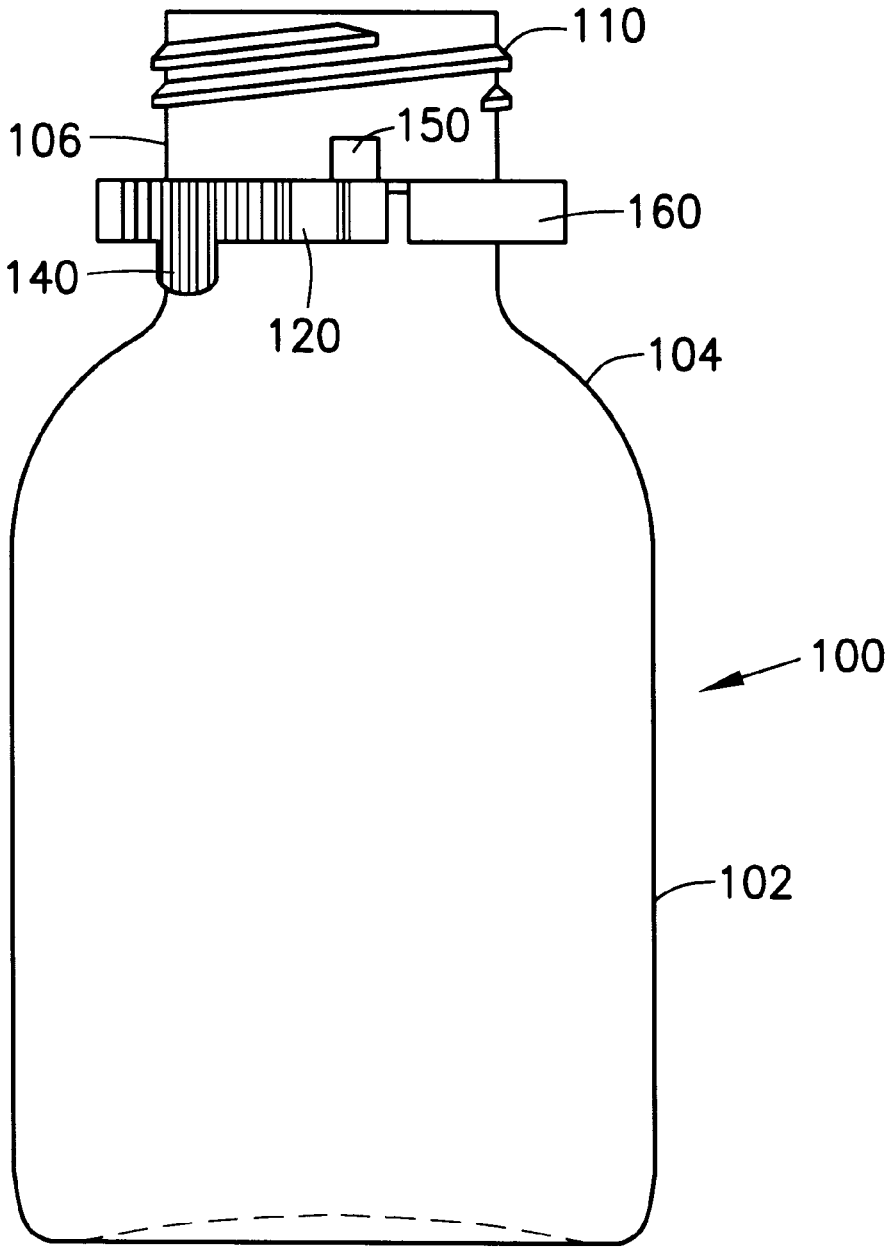
FIG. 1 illustrates a side view of the pivot arm and collar on the container of the container and closure device, according to an embodiment of the present invention.

FIGS. 1 to 11 show the construction of a child resistant and adult friendly container and closure device according to the present invention. A container 100 and a closure 200 are fitted together by inter-engaging threads 110, 210 upon rotation of the closure 200 onto the container 100 in a closing direction. The closure 200 is locked onto the container 100 by two cooperating locking surfaces 152, 252, respectively of a locking lug 150 on the container 100 and of a detent 250 on the closure 200. The closure 200 cannot be removed from the container 100 without first manually activating a pivot arm 120 on the container 100, so that the cooperating locking surfaces 152, 252 of the locking lug 150 and of the detent 250 are disengaged.

Referring specifically to FIGS. 1 to 5, a container 100 includes a neck 106 extending from a container shoulder 104 and a receptacle portion 102. The container shoulder 104 and the receptacle portion 102 may be any suitable size and shape, and are preferably integrally connected to the neck 106. The container 100 and the neck 106 can thus be manufactured as a unitary structure, and can be manufactured from a material such as a plastic, or some other suitable material. As such, one particular type of manufacturing process from which the container 100 can easily be made is blow-molding. The container 100 and neck 106 preferably is stretch blow-molded using an injection molding stage to form the neck 106 and tabs The preferred material are plastics such as polyethylene-terathalate (PET) and polypropylene (PP). The top of the neck 106 contains a hollow opening to permit access to the contents of the container 100 contained within the receptacle portion 102. Further, threads 110 extend from and encircle the neck 106 along its outer circumference. The threads 110 have a beginning and an end and preferably are pitched so as to travel over at least one full turn of the circumference of the neck 106. In addition, the thread system on the container 100 may include multiple threads of various lengths and sizes dependent upon the specific embodiment of the present invention.

A pivot arm 120 is attached to neck 106 below the threads 110 via a flexible pivot member 130, extending radially outward from neck 106. Pivot member 130 should be positioned at a point intermediate of the ends of pivot arm 120, so that the pivot arm 120 pivots about pivot member 130, preferably in an axis normal to the circumference of the neck 106. The pivot 130 should be flexible enough to allow pivot arm 120 to engage and disengage the cooperating locking surfaces 152, 252 of the detent 250 and the locking lug 150. Preferably, the pivot 130 allows for a movement of the pivot arm 120 of 25 to 30 degrees to either side of a rest position, as measured from the point of attachment on the outer surface of the neck 106. The pivot 130 should be constructed of a material that is flexible and not unduly subject to breakage, preferably a durable plastic such as PET or PP. The pivot 130 and the pivot arm 120 preferably are constructed of the same material, and preferably are an integral unit.

Figure 2:
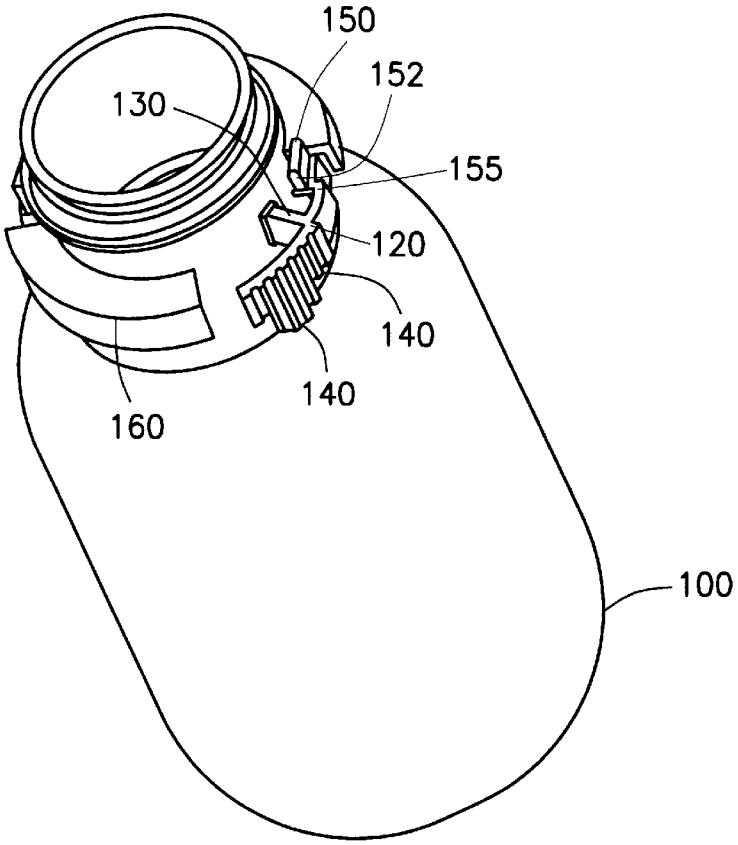
FIG. 2 illustrates a top angle view of the pivot, pivot arm and collar on the container of the container and closure device, according to an embodiment of the present invention.
Figure 3:
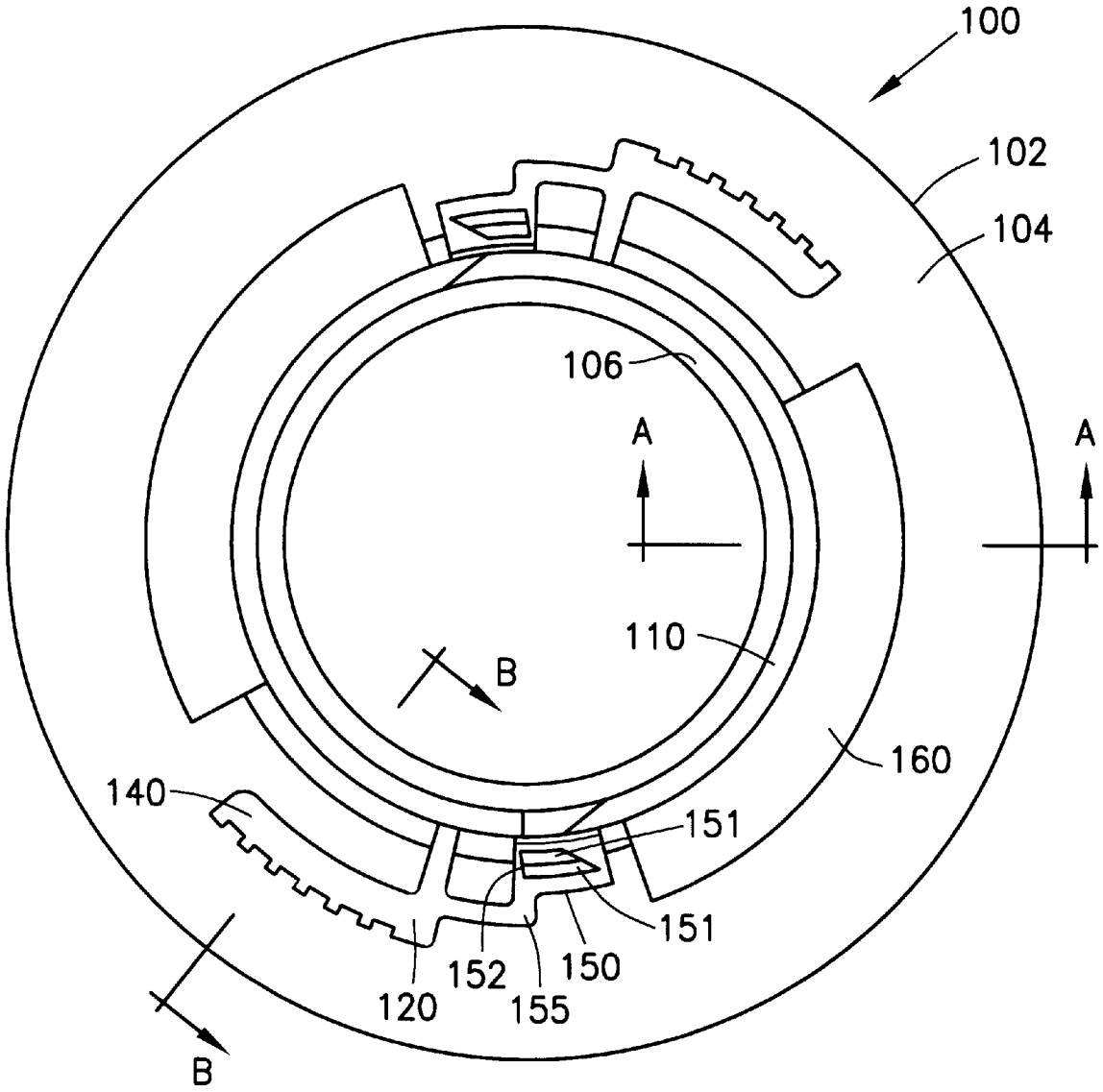
FIG. 3 illustrates a top view of the pivot, pivot arm and collar on the container of the container and closure device, according to an embodiment of the present invention.
Figure 4:
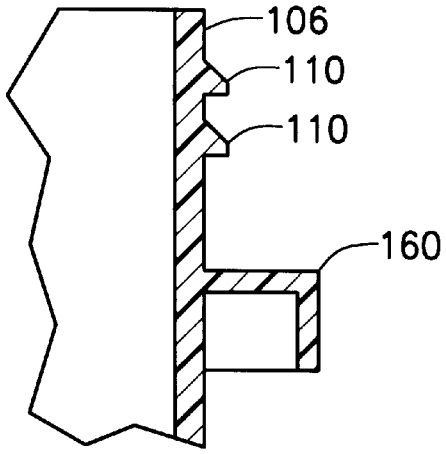
FIG. 4 illustrates a side view of the collar on the container of the container and closure device, according to an embodiment of the present invention, cut-away along axis A—A of FIG. 3.
Figure 5:
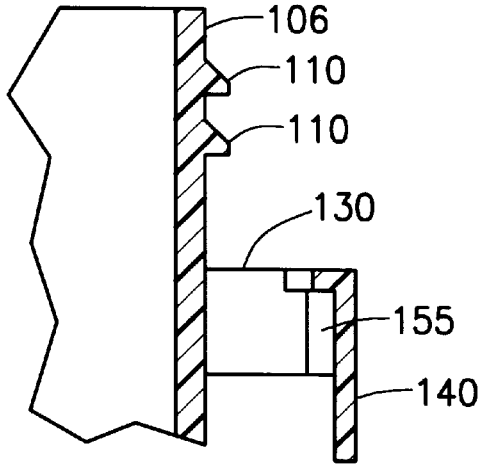
FIG. 5 illustrates a side view of the pivot and pivot arm on the container of the container and closure device, according to an embodiment of the present invention, cut-away along axis B—B of FIG. 3.

As is shown in FIGS. 2 and 3, one end of the pivot arm 120 (containing locking surface 152) preferably is a lesser distance from the surface of the neck 106 in the rest position than is the opposite end of the pivot arm 120. This arrangement will allow for the closer end to engage with a detent 250 on the closure 200, while allowing the other end, further away from the outer surface of the neck 106, to have space in which to flex towards the neck 106 in order to disengage the locking mechanism.

A pushtab 140 is positioned on the pivot arm 120 on the side of the pivot arm opposite the locking surface 152. The pushtab 140 should be constructed of a material which resists breakage after repeated manipulation, and is preferably made of the same material as the pivot arm 120 and pivot member 130. The pushtab 140 preferably has an outer surface suitable for manual manipulation, which most preferably is ribbed or serrated. Although the pushtab 140 may be of uniform thickness, preferably it tapers in thickness from a thicker top toward a thinner bottom. The thicker portion of the pushtab 140 can assist in more efficiently transmitting the forces applied to the pushtab 140 about the pivot 130 to locking surface 152.

Figure 7:
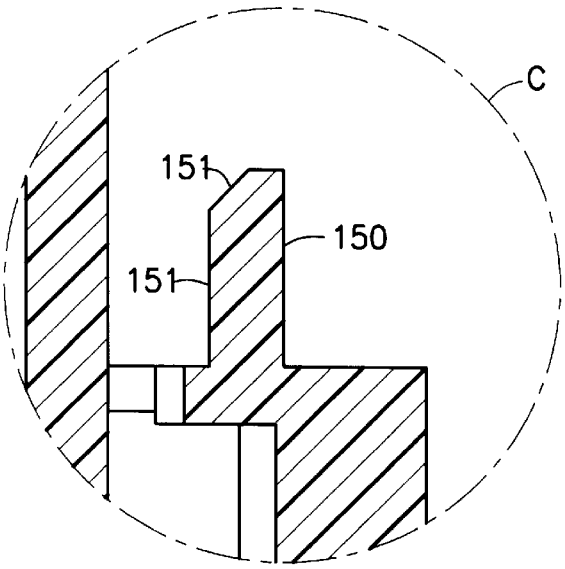
FIG. 7 illustrates an exploded view of the pivot, pivot arm and lock, according to an embodiment of the present invention, of the area encircled by circle C of FIG. 6.
Figure 6:
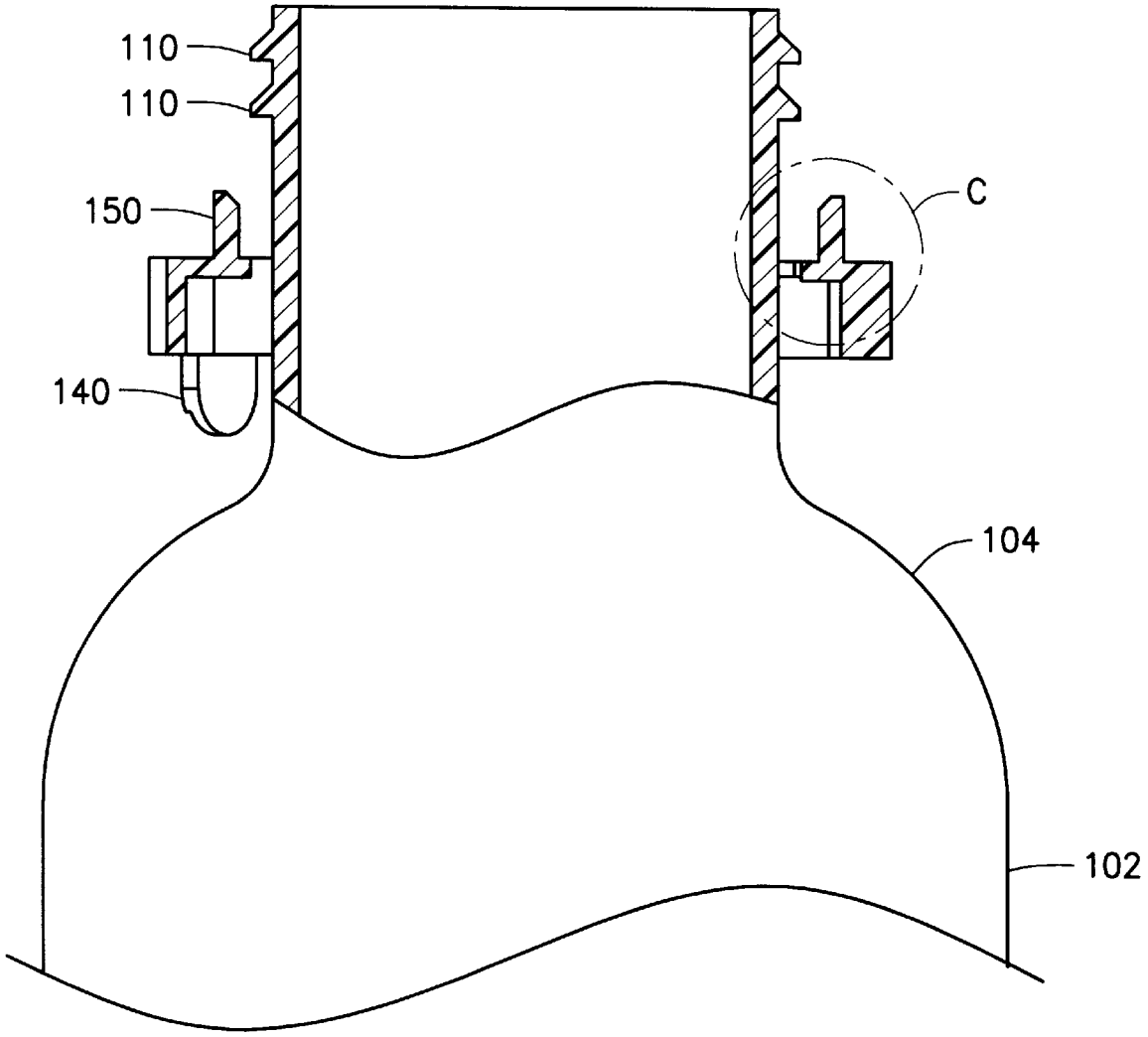
FIG. 6 illustrates a cut-away side view of the pivot, pivot arm and lock, according to two embodiments of the present invention.

Referring to FIGS. 3, 6 and 7, a locking lug 150 is positioned on, and preferably integrally connected to, a locking end 155 of the pivot arm 120. Locking lug 150 preferably is constructed of the same material as pivot arm 120. The locking lug 150 has two cooperating surfaces for cooperation with corresponding cooperating surfaces of the detent 250 on the closure 200. A cooperating sliding surface 151 is constructed so that it faces the neck 106 of the container 100, and is capable of cooperating with a corresponding sliding surface of the detent 250. The sliding surface 151 preferably has three surface portions, two of which angle away from the neck 106 of the container 100 and lead to a point, as shown in FIGS. 3, 6 and 7, in order that the sliding surface 151 will properly engage the cooperating sliding surface of the detent 250. In explanation, an upper portion of sliding surface 151 will angle away from a vertical axis of the neck, preferably at a 45 degree angle as shown in FIGS. 6 and 7, while a frontal portion of the sliding surface 151 will angle away from a horizontal axis of the neck 106, preferably at a 30 degree angle as shown in FIG. 3. The angled upper portion and the angled frontal portion of the sliding surface 151 act together to catch the cooperating surface of the detent 250, inside of their common point, as the detent 250 is rotatably screwed downward in a tightening direction. The cooperating surface of the detent 250 is then passed to the surface portion of the sliding surface 151 directly facing the neck 106.

Figure 8:
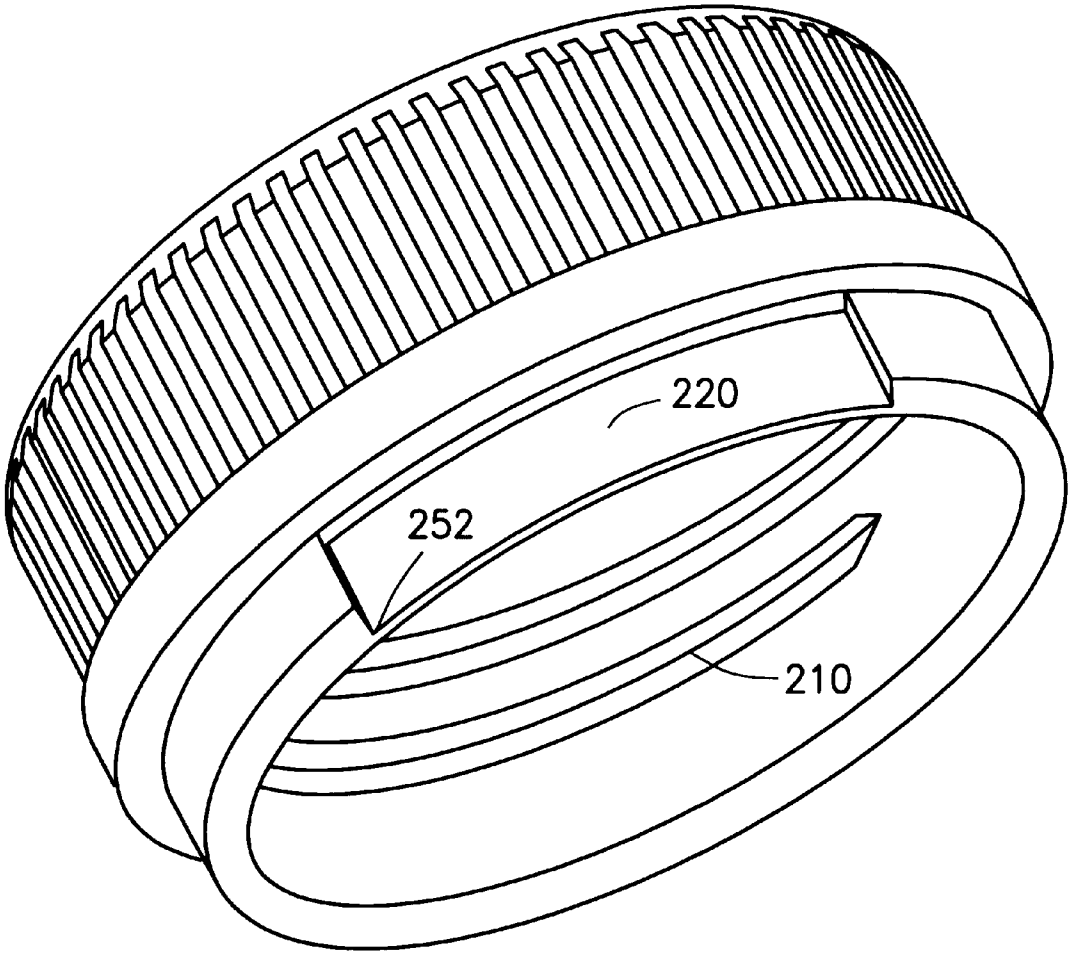
FIG. 8 illustrates a bottom angle view of the closure showing the inter-engaging threads on the inside surface of the skirt of the closure and the detent on the lower portion of the outside surface of the skirt of the closure, according to an embodiment of the present invention.
Figure 9:
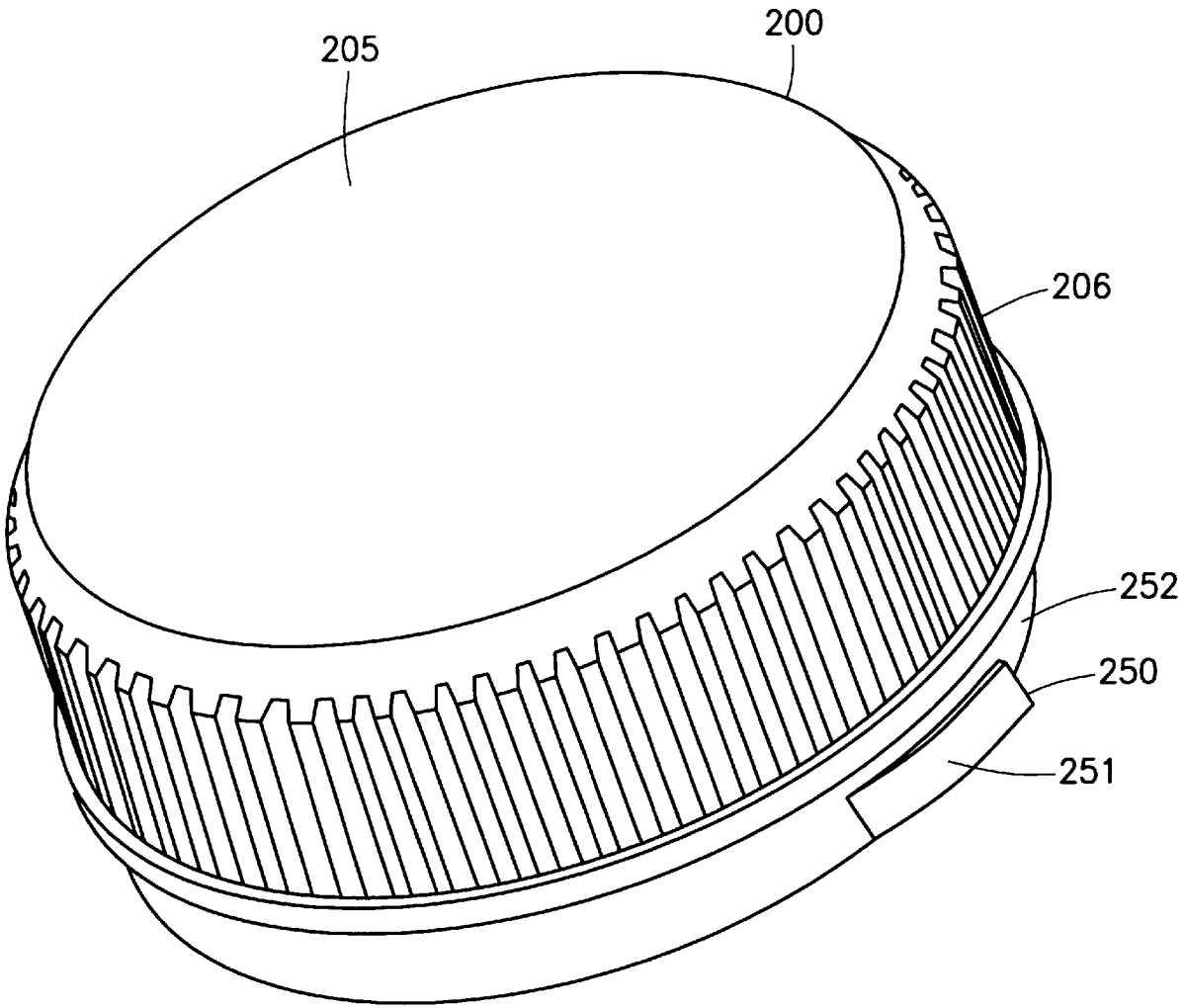
FIG. 9 illustrates a top angle view of the closure showing the detent on the lower skirt of the closure, according to an embodiment of the present invention.

Referring to FIGS. 8 and 9, the closure 200 includes a base 205 and an annular skirt 206 depending therefrom, which define an opening into which the neck 106 of the container 100 fits. The closure has a single wall construction, as shown in FIGS. 8 and 9. The closure is preferably constructed of plastic, such as PET, and can be manufactured by injection molding. An outside surface of the annular skirt 206 is serrated with grooves to provide a gripping surface for easy manipulation. On an inner surface of the annular skirt 206 is an inter-engaging thread 210, as shown in FIG. 8, complementary to the thread 110 on the neck 106 of the container 100. The thread 210 follows the circumference of the inner surface of the closure 200 and is pitched so as to travel over at least one revolution of the inner circumference. In this manner then, the inter-engaging threads 210 of the closure 200 are designed to complementarily engage with the threads 110 of the container 100 so as to permit the closure 200 to be rotatably screwed onto the container 100 in one direction and rotatably screwed off the container 100 in an opposite direction. The closure 200 further has a lower annular skirt 220 integrally connected to the annular skirt 206. The outside surface of the lower annular skirt 220 has a detent 250 extending therefrom. The detent 250 has two cooperating surfaces which respectively cooperate with the two corresponding cooperating surfaces of the locking lug 150.

One of the cooperating surfaces of the detent 250 is the cooperating sliding surface 251. Sliding surface 251 gradually extends away from the outer surface of the lower annular skirt 220, preferably in a gentle curve as shown in FIG. 9, and ends abruptly at a point connecting at the cooperating locking surface 252. At this point the sliding surface 251 is preferably 0.06 inches from the outer surface of the lower annular skirt 220. The sliding surface 251 is designed to cooperate with the sliding surface 151 of the locking lug 150 to enable the closure 200 to be rotatably screwed onto the container 100. As the closure 200 is rotatably screwed onto the container 100 in a tightening direction, the angled surfaces of the sliding surface 151 on the locking lug 150 catch sliding surface 251 and pass it to the surface portion of the sliding surface 151 directly facing the neck 106. As the sliding surface 251 extends further from the outer surface of the closure 200, the now abutting sliding surface 151 of the locking lug 150 causes the pivot arm 120 to pivot about the axis of the pivot 130 such that the locking end 155 moves away from the outer surface of the neck 106. The sliding movement continues until the sliding surface 151 reaches the connection point between the sliding surface 251 and the locking surface 252 of the detent 250 where the locking surface 252 returns directly to the outer surface of the lower annular skirt 220.

Figure 10:
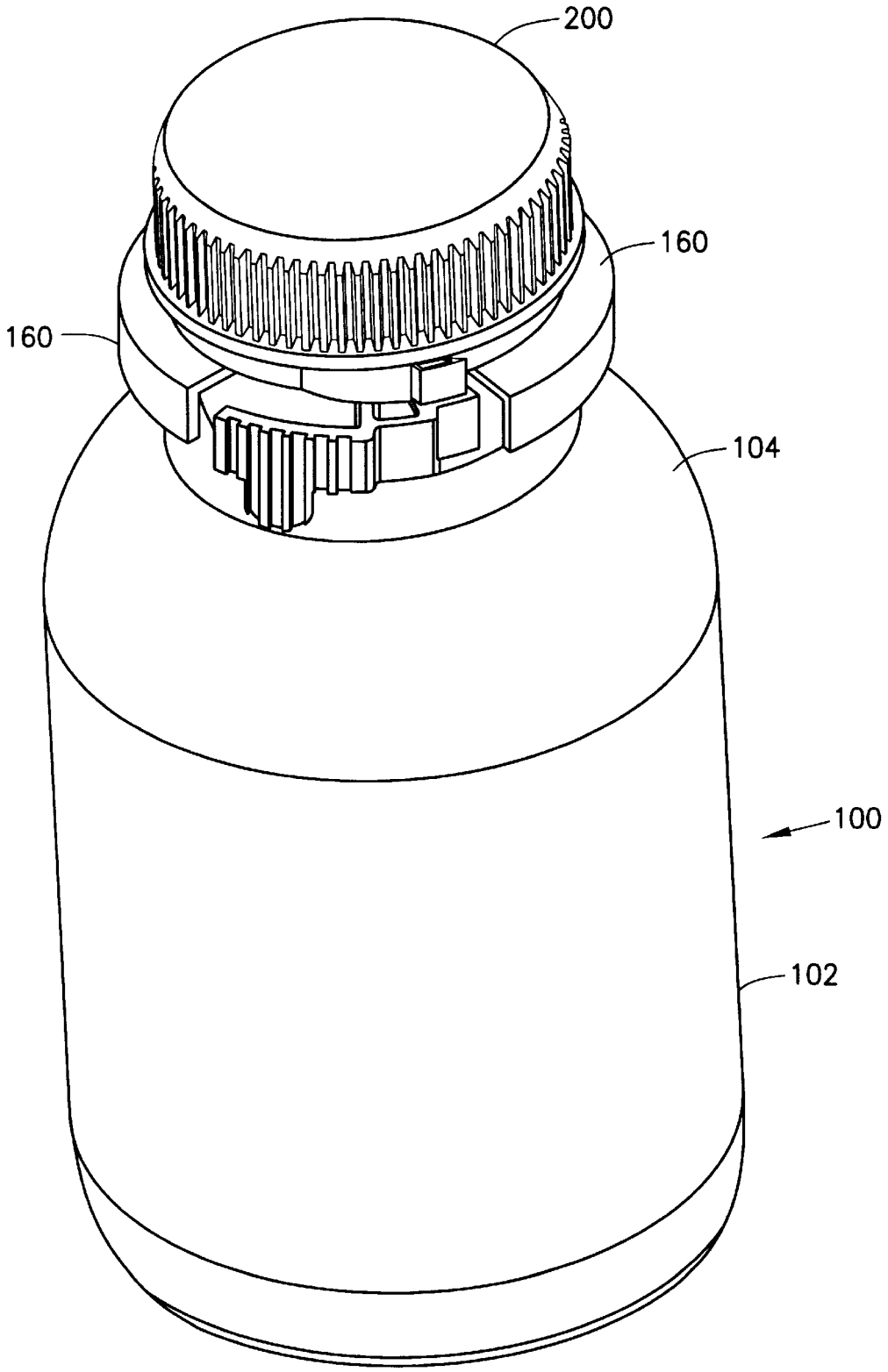
FIG. 10 illustrates a view of the closure screwed onto the container with the locking lug of the container engaging the detent of the closure, according to an embodiment of the present invention.
Figure 11:
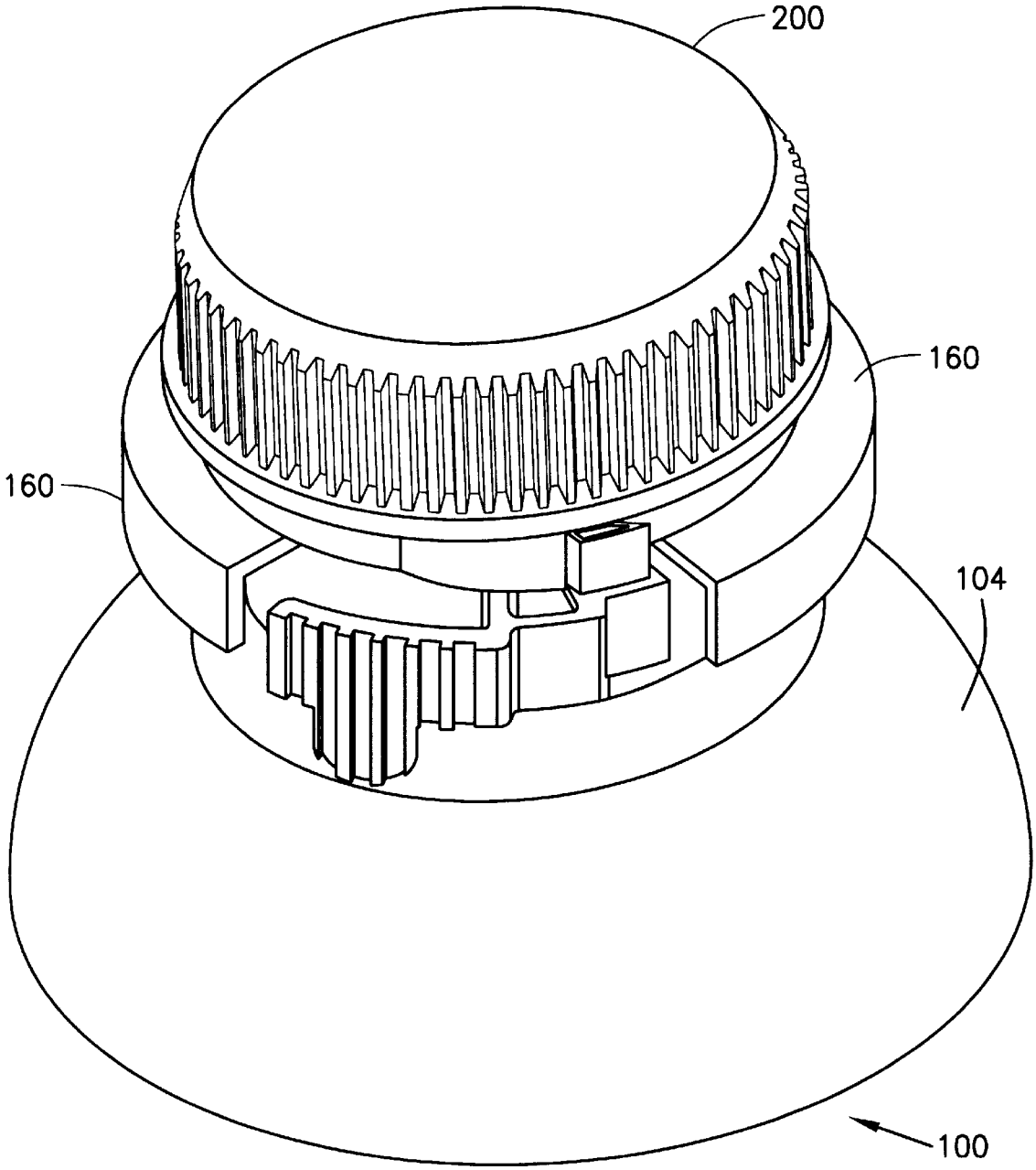
FIG. 11 illustrates a closer view of the closure screwed onto the container with the locking lug of the container engaging the detent of the closure, according to an embodiment of the present invention.

As the cooperating detent 250 slides fully past the locking lug 150 the locking end 155 returns to the rest position with an audible click. The locking surface 152 and the locking surface 252 now abut one another as shown in FIGS. 10 and 11. In a preferred embodiment, the locking surfaces 152, 252 are correspondingly angled 15 degrees off of a centerline running straight out from the outer surfaces of the closure 200 and the neck 106 of the container 100, as shown in FIGS. 3 and 8. This angle allows the locking surfaces 152, 252 to resist a greater force of pressure then they would be able to withstand if angled at 90 degrees if the closure 200 was to be rotatably screwed in an opening direction without first manipulating the pushtab 140. At this point then, the closure 200 is locked onto the container 100, as the cooperating locking surfaces 152, 252 of the locking lug 150 and the detent 250, respectively prevent the closure 200 from being rotatably screwed in an opening direction. The closure 200 cannot be removed from the container 100 without first manually activating the pivot arm 120 on the container 100 so that the cooperating locking surfaces 152, 252 of the locking lug 150 and of the detent 250, respectively, are disengaged.

According to various embodiments of the present invention, more than one pivot arm 120 having a locking lug 150 may be attached to the container 100, and, correspondingly, more than one detent 250 may be attached to the closure 200. The preferred embodiment has two of each. In the preferred embodiment each pivot arm 120 has the locking end 155 in the same direction around the circumference of the neck 106, i.e. 180 degrees offset from the other, as shown in FIG. 3. An alternate embodiment, however, may have each pivot arm 120 as a mirror image of the other such that the locking ends 155 face each other. If more than one is attached, each must be manipulated simultaneously in order to allow for removal of the closure 200 from the container 100.

In an exemplary embodiment of the present invention, a collar 160 also extends outwardly from the neck 106 along the same horizontal plane as the pivot arm 120 in a fashion to help prevent accidental manipulation of the pivot arm 120, as shown in FIGS. 1 to 4. The collar 160 extends outwardly along the horizontal plane only in the areas left vacant by the pivot arm 120, and is such that the outer circumference of the collar 160 away from the neck 106 is equal to the outer circumference of the pivot arm 120. Further the width of the collar 160 is the same as the width of the pivot arm 120. Thus a generally smooth outer circumference is preferably presented, except for a small space between the ends of the collar 160 and the ends of the pivot arm 120, so that even if the container 100 where lying on its side, the pivot arm 120 would not be accidentally manipulated.

It is to be understood and expected that variations in the principles of construction herein disclosed in an embodiment may be made by one skilled in the art and it is intended that such modifications, changes, and substitutions are to be included with the scope of the present invention.

What is claimed is:

1. A child resistant and adult friendly container and closure device, comprising:

a container, the container comprising:

a receptacle portion;

a neck projecting from the receptacle portion, the neck defining an opening accessible to the receptacle portion of the container;

at least one thread engaging the neck along an outer surface circumference of the neck; and at least one pivot arm, pivoting about a vertical axis around a pivot attached at a point to the neck below the at least one thread, having a locking end with a locking lug as a first end and a pushtab end as a second end with the pivot positioned intermediate of the first end and the second end; and a closure, the closure comprising:

a top surface; and an annular skirt, integrally connected to an outer radius of the top surface and defining an opening into which the neck of the container fits;

at least one thread, on an inner surface of the annular skirt, for complementary engagement with the thread engaging the neck of the container;

at least one detent, on a lower portion of a radially outer surface of the annular skirt, for engagement with the locking lug outside the radially outer surface of the annular skirt, wherein when the closure is rotatably screwed onto the neck of the container in a closing direction, the engagement of the detent and the locking lug prevent the closure from being rotatably screwed off of the neck of the container in an opening direction.

2. The child resistant and adult friendly container and closure device according to claim 1, wherein the closure can only be screwed off of the container in the opening direction by a manual manipulation of the pushtab end towards the neck of the container so that the locking lug disengages from the detent on the closure.

3. The child resistant and adult friendly container and closure device according to claim 1, wherein the detent has a first surface for allowing the locking lug to slide over it in a closing direction and a second surface to prevent the locking lug from sliding over it in an opening direction.

4. The child resistant and adult friendly container and closure device according to claim 1, wherein the locking lug has a first surface to catch and slide over the detent and a second surface to prevent the detent from sliding over it.

5. The child resistant and adult friendly container and closure device according to claim 1, wherein the detent and locking lug each have a cooperating sliding surface which cooperate to allow the closure to be fully screwed onto the container in a closing direction.

6. The child resistant and adult friendly container and closure device according to claim 1, wherein the detent and locking lug each have a cooperating locking surface which cooperate to prevent the closure from being screwed off of the container in an opening direction without a manual manipulation of the pushtab end towards the neck of the container so that the locking lug disengages from the detent on the closure.

7. The child resistant and adult friendly container and closure device according to claim 1, wherein the container and closure are made of plastic.

8. The child resistant and adult friendly container and closure device according to claim 1, wherein the container is made of glass and the closure is made of plastic.

* * * * *